US012390686B2

(12) United States Patent
Kueker

(10) Patent No.: US 12,390,686 B2
(45) Date of Patent: Aug. 19, 2025

(54) ABDOMINAL CRUNCH EXERCISE MACHINE

(71) Applicant: True Fitness Technology, Inc., O'Fallon, MO (US)

(72) Inventor: Jared Kueker, St. Charles, MO (US)

(73) Assignee: True Fitness Technology, Inc., O'Fallon, MO (US)

( * ) Notice: Subject to any disclaimer, the term of this patent is extended or adjusted under 35 U.S.C. 154(b) by 220 days.

(21) Appl. No.: 18/128,795

(22) Filed: Mar. 30, 2023

(65) Prior Publication Data

US 2023/0381580 A1 Nov. 30, 2023

Related U.S. Application Data

(60) Provisional application No. 63/325,270, filed on Mar. 30, 2022.

(51) Int. Cl.
*A63B 23/02* (2006.01)
*A63B 21/00* (2006.01)
*A63B 21/062* (2006.01)

(52) U.S. Cl.
CPC ..... *A63B 23/0222* (2013.01); *A63B 21/0628* (2015.10); *A63B 21/4034* (2015.10); *A63B 21/4035* (2015.10); *A63B 21/4047* (2015.10)

(58) Field of Classification Search
CPC ..... A63B 21/0628; A63B 21/4029; A63B 21/4031; A63B 21/4034; A63B 21/4035; A63B 21/4047; A63B 23/0222; A63B 23/03525; A63B 2208/0233
See application file for complete search history.

(56) References Cited

U.S. PATENT DOCUMENTS 4,387,893 A * 6/1983 Baldwin ..... A63B 21/06 482/137
5,711,749 A * 1/1998 Miller ..... A63B 21/4047 482/142
8,172,732 B1 * 5/2012 Webber ..... A63B 21/0615 482/97
9,522,297 B2 12/2016 Webber et al.
2006/0211549 A1 * 9/2006 Nohejl ..... A63B 21/159 482/93
2008/0085822 A1 * 4/2008 Webb ..... A63B 23/0222 482/140
2010/0105533 A1 * 4/2010 Nohejl ..... A63B 23/0211 482/140

(Continued)

OTHER PUBLICATIONS

Scotthermanfitness, "How To: Abdominal Crunch (Hammer Strength)," youtube.com, Sep. 24, 2009, Retrieved from Internet: <https://www.youtube.com/watch?v=_O1xunCfYEM>, 1 page.

*Primary Examiner* — Gary D Urbiel Goldner
(74) *Attorney, Agent, or Firm* — Lewis Rice LLC

(57) ABSTRACT

An exercise machine, components of the exercise machine, and methods related to using the exercise machine that allow for a performance of an abdominal exercise which provides for a more natural rolling motion for a back of a user while providing variable resistance. Specifically, at least one of a seat or a backrest of the exercise machine, and preferably both, is not rotationally attached directly to a frame of the exercise machine, but is instead rotationally attached to a secondary arm of the exercise machine which is then rotationally attached to the frame.

20 Claims, 8 Drawing Sheets

(56) References Cited

U.S. PATENT DOCUMENTS

2011/0301002 A1* 12/2011 Sebastian ..... A63B 21/068
482/142
2018/0147436 A1* 5/2018 Ellis ..... A63B 21/0617

* cited by examiner

ABDOMINAL CRUNCH EXERCISE MACHINE

CROSS REFERENCE TO RELATED APPLICATION(S)

This application claims the benefit of U.S. Provisional Patent Application 63/325,270 filed Mar. 30, 2022, the entire disclosure of which is herein incorporated by reference.

BACKGROUND OF THE INVENTION

Field of the Invention

This disclosure relates to the field of exercise machines. In particular, to exercise machines designed to assist in the performance of abdominal crunch exercises.

Description of the Related Art

Over recent years, as physical fitness has become an ever more popular pursuit, there have evolved a plurality of exercise machines upon which exercises can be performed by a user. One type of exercise machine is the strength machine which is designed to improve muscle strength and tone by having the user utilize certain muscle groups to pull, push or otherwise perform work on some type of resistance mechanism built into the machine.

As the nature of exercise has become more fully understood, different types of exercise machines have been developed to provide for more effective training. Originally, strength training was performed by the lifting of free-weights or by performing body mass exercises where the body itself is used to provide the resistance to the muscle. While simple to understand and operate, free-weight exercises, and even body mass exercises, have inherent dangers in their use. In the first instance, free-weights have essentially no safety mechanisms to inhibit the weight from falling on the user. Further, both free-weight and body mass exercises, although conceptually simple, are often hard to perform correctly without trained instruction. Failure to perform an exercise correctly not only doesn't produce the best toning or shaping results, but it can also result in injury.

In all forms of strength exercise, it is typically desirable that muscle groups be isolated so that the intended muscle group is exercised by the exercise, as opposed to exercising an unintended muscle group. Further, as exercising necessarily involves work to be effective, a user can, intentionally or not, alter the motion of an exercise to make it easier. Often, this is done inadvertently when the exercise is performed without an instructor to observe the motion or when a new exercise is being learned and the user does not have a good understanding of what the motion should be and what it should feel like when performed correctly.

When utilizing body mass or free-weights it is also often not possible to perform exercises that isolate certain muscle groups because the necessary motion of the human body is simply not possible based on the direction of gravity and/or it requires an excess of balance or other action which the average user does not have. Even if an exercise is possible, actually performing it correctly without assistance can still be difficult. Strength machines came about to attempt to resolve many of these problems, and as they have evolved, they have tried to increase both the safety of performing different exercises, and the effectiveness of the exercise to isolate different muscle groups by providing fixed movements to the user.

To most effectively isolate and exercise particular muscle groups, it is desirable that the exercise machine be arranged so that the user is limited in their range of motion to that which effectively performs the desired exercise on the desired muscle groups against a known resistance. This effectiveness is generally provided by the selection and arrangement of two components of the machine. First and foremost, there is a bench, seat or other structure which supports the user's body. For some exercises, this may be as simple as the floor upon which the machine rests, while for others adjustable benches may be provided to position portions of the user's body interacting with appropriate pieces of the exercise machine. These components help to get the user in a comfortable position where they can operate the moving portions of the machine, and place them in a position relative to the moving parts of the machine so that they manipulate those parts to correctly perform the exercise as it is essentially the only motion available to them.

The other component of the machine is the moving portion of the machine which is arranged in a manner to be engaged by the user at a certain point (such as a grip or handle), and then be moved by the user in a manner such that the grip follows a predetermined path and the motion of the grip is resisted by the machine. This effectively constrains the user's motion to a path, which path should supply the desired exercise methodology. When the two components of the machine are used together correctly, the user is therefore positioned in such a manner that when the grip is moved by the user in the predetermined path, and the particular muscle group to be exercised must be utilized to move the grip in that path. This results in the user both isolating a muscle group and performing the exercise motion safely.

Many strength machines, however, have had to settle for imperfect range of motion for some or all of the exercises they are intended to be used for. In particular, abdominal exercises can be particularly challenging to design exercise machines for performing. The abdominal muscles are in the middle of the human body and abdominal exercises typically require the user to bend at their midsection. Most abdominal exercises utilize body mass as the primary resistance and are as simple and well-known as the act of touching one's toes or doing a sit-up. A more preferred form of abdominal exercise currently is the abdominal crunch. The crunch is, in many respects, the successor to the sit-up. While the sit-up had the user go from lying flat on the floor to a position with the back almost vertical, the crunch actually has a relatively constrained range of motion and relates more to a user "balling-up" than bending (which can be hard on the back).

In an abdominal crunch, the user typically starts with their back flat on the floor (or more accurately with their back naturally curved and their shoulders against the floor) with their legs bent and their feet flat on the floor. This results in a generally obtuse angle approaching 90 degrees between their thighs and their back. The user then rolls up their shoulders towards their knees using their abdominal muscles to generate the force. Resistance is created from lifting the mass of the head and shoulders against gravity as well as the act of bending. If additional resistance is desired, a mass is typically placed on the upper chest or shoulders. While the shoulders are moved toward the knees, the motion typically results in moving the shoulders only a few inches upward. This is to avoid strain on the back (and particularly the lower back) from going higher. In some variations, the feet are lifted and the knees are pulled toward the head.

It is important to recognize that the motion of the abdominal crunch is more one of rolling at the midsection as opposed to true bending. Specifically, if one stands upright and bends over to touch the toes while keeping their legs and back straight, the user will bend at their midsection. However, this type of rigid bending is undesirable. Instead, in a correctly performed abdominal crunch, the user doesn't rigidly bend at their midsection, but more rolls into a ball around it. This rolling provides a more natural movement of the spine. However, one of the limitations on performing the crunch is that the floor on which it is performed is typically flat and rigid. If one was to lay on their side and curl into a ball, rolling of the back will typically result in the legs coming more toward the chest and only the shoulders being bent in toward the legs. In many respects, this will cause the buttocks to appear to push backward and is similar to the motion of bending down but bending the knees instead of keeping them straight.

This rolling action with the legs bent is a much more natural motion than bending at the midsection between two straighter body halves as keeping the back straight is often uncomfortable and can also strain the spine. However, in a crunch, to provide body mass resistance, the floor is usually in the way of the lower back moving backward and the buttocks moving at all (since they are typically on the floor and supporting the user). This is part of the concern for back strain while performing the exercise Strength machines for performing abdominal exercises often try to mimic the motion of an abdominal crunch by having the user lie on a flat surface and perform the same exercise motion, but with additional resistance through inclination or the addition of weights which may be lifted via the intended motion. This provides for a better exercise by providing an exercise where more muscle force is required. However, these machines don't resolve the problems related to the motion itself as they still utilize a flat bench or support and effectively the same motion as is performed on the floor.

For more sophisticated machines, the user is positioned in a generally elevated sitting position on a chair that is "split". Specifically, the back is placed against a back rest while the buttocks and upper thighs are supported on a seat. Their feet are hooked under foot pads and their arms are bent with their hands above their head to grasp handles above their head. The user is, thus, provided with effectively two parts of the machine, one for their lower half (which can be thought of as defined by the position of the seat) and one for their upper half (which can be thought of as defined by the position of the backrest). The user will then bend at their midsection moving their hands and arms in a fairly natural arc downward while the feet rotate upward and forward. The machines typically provide rotation for both the upper half and the lower half around a common axis of rotation or two independent axis of rotation that are positioned close to each other. Specifically the motion of the both the upper half and lower half structures are each directly rotational relative to the frame which supports them. Thus, both halves, and, thus, the seat and backrest, typically both rotate around an axis which is rigid relative to the frame The best way to think about the motion is by considering the motion of the covers of a hardback book being closed with the two covers being both moved together at the same time. Consider taking a book, opening the front cover and placing the front cover against the palm of one hand and the back cover against the palm of the other. Now with the hands held in a "V" in front of the body, the book is closed by moving the palms of the two hands toward each other without moving the wrists. This motion creates a clamshell movement of the book where the covers rotate relative to the spine, but the spine (which is positioned near the wrists) does not move.

While such a clamshell movement provides for an exercise motion which allow for engagement of the abdominal muscles (which are effectively positioned between the two halves of the machine and thus are primarily engaged to move the two halves relative to each other. This results in the seat and the backrest rotating about each other with each being effectively rigidly positioned, as opposed to the desired rolling motion.

SUMMARY OF THE INVENTION

The following is a summary of the invention in order to provide a basic understanding of some aspects of the invention. This summary is not intended to identify key or critical elements of the invention or to delineate the scope of the invention. The sole purpose of this section is to present some concepts of the invention in a simplified form as a prelude to the more detailed description that is presented later.

Because of these and other problems in the art, disclosed herein is an exercise machine, components of an exercise machine, and methods related to using an exercise machine that allow for the performance of an abdominal exercise which provides for a more natural rolling motion for the back while providing variable resistance. Specifically, at least one of the seat or backrest, and preferably both, is not rotationally attached directly to the frame of the machine, but is instead rotationally attached to a secondary arm which is then rotationally attached to the frame. In the book example, this allows for the wrists to move as the book is closed, which provides for a motion which is not as rigid in its bending.

In an embodiment, there is described herein an exercise machine comprising: a frame; a lower support connected to said frame at two spaced axes of rotation via a first linkage assembly; an upper support connected to said frame at two spaced axes of rotation via a second linkage assembly; a translation bar connecting said first linkage assembly to said second linkage assembly so that movement of said lower support relative said frame causes movement of said upper support relative to said frame and movement of said upper support relative to said frame causes movement of said lower support relative said frame; and a resistance mechanism resisting movement of at least one of said lower support or said upper support relative to said frame.

In an embodiment of the exercise machine, the lower support is rotationally attached to said first linkage assembly via an additional axis of rotation spaced from said two spaced axes of rotation connecting said lower support to said frame.

In an embodiment of the exercise machine, the upper support is rotationally attached to said second linkage assembly via an additional axis of rotation spaced from said two spaced axes of rotation connecting said upper support to said frame.

In an embodiment of the exercise machine, the lower support is rotationally attached to said first linkage assembly via an additional axis of rotation spaced from said two spaced axes of rotation connecting said lower support to said frame and the upper support is rotationally attached to said second linkage assembly via an additional axis of rotation spaced from said two spaced axes of rotation connecting said upper support to said frame.

In an embodiment of the exercise machine, the lower support includes a seat and foot pads.

In an embodiment of the exercise machine, the seat comprises a seat base and a seat back.

In an embodiment of the exercise machine, the upper support includes a back rest and hand grips.

In an embodiment of the exercise machine, the first linkage assembly comprises: a first frame rotation arm rotationally connected at a first end to said frame and rotationally connected at a second end, opposing said first end, to a first end of a seat engaging arm which is attached to said lower portion; and a second frame rotation arm rotationally connected at a first end to a second end of said seat engaging arm opposing said first end of said seat engaging arm and rotationally connected at an opposing second end to said frame.

In an embodiment of the exercise machine, the seat engaging arm is rigidly attached to said lower portion.

In an embodiment of the exercise machine, the second linkage assembly comprises: a first back rotation arm rotationally connected at a first end to said frame and rotationally connected at a second end, opposing said first end, to a first end of a back engaging arm which is attached to said upper portion; and a second back rotation arm rotationally connected at a first end to a second end of said back engaging arm opposing said first end of said back engaging arm and rotationally connected at an opposing second end to said frame.

In an embodiment of the exercise machine, the back engaging arm is rigidly attached to said upper portion.

In an embodiment of the exercise machine, the translation bar is connected at a first end to said second end of said seat engaging arm, and a second end of said translation bar, spaced from said first end of said translation bar, is connected to said back rotation arm at an axes spaced from said first end and said second end of said back rotation arm.

In an embodiment of the exercise machine, the resistance mechanism comprises a weight stack.

There is also described herein, in an embodiment, a method of performing an abdominal crunch exercise, the method comprising: providing an exercise machine comprising: a frame; a lower support including a seat and foot pads, said lower support connected to said frame at two spaced axes of rotation via a first linkage assembly; an upper support including a back rest and hand grips, said upper support connected to said frame at two spaced axes of rotation via a second linkage assembly; a translation bar connecting said first linkage assembly to said second linkage assembly; and a resistance mechanism resisting movement of at least one of said lower support or said upper support relative to said frame; sitting on said seat against said back rest; placing a portion of a lower extremity in contact with said foot pads; grasping said hand grips; and using abdominal muscles to move at least one of said foot pads or said hand grips against resistance provided by said resistance mechanism where movement of said lower support relative said frame causes movement of said upper support relative to said frame and movement of said upper support relative to said frame causes movement of said lower support relative said frame.

In an embodiment of the method, the first linkage assembly comprises: a first frame rotation arm rotationally connected at a first end to said frame and rotationally connected at a second end, opposing said first end, to a first end of a seat engaging arm which is attached to said lower portion; and a second frame rotation arm rotationally connected at a first end to a second end of said seat engaging arm opposing said first end of said seat engaging arm and rotationally connected at an opposing second end to said frame.

In an embodiment of the method, the seat engaging arm is rigidly attached to said lower portion.

In an embodiment of the method, the second linkage assembly comprises: a first back rotation arm rotationally connected at a first end to said frame and rotationally connected at a second end, opposing said first end, to a first end of a back engaging arm which is attached to said upper portion; and a second back rotation arm rotationally connected at a first end to a second end of said back engaging arm opposing said first end of said back engaging arm and rotationally connected at an opposing second end to said frame.

In an embodiment of the method, the back engaging arm is rigidly attached to said upper portion.

In an embodiment of the method, the translation bar is connected at a first end to said second end of said seat engaging arm, and a second end of said translation bar, spaced from said first end of said translation bar, is connected to said back rotation arm at an axes spaced from said first end and said second end of said back rotation arm.

In an embodiment of the method, the resistance mechanism comprises a weight stack.

BRIEF DESCRIPTION OF THE DRAWINGS

FIG. 3A depicts a typical starting position for an ab crunch exercise and FIG. 3B depicts a typical ending positon. FIG. 3C illustrates a positon typically beyond that used during an exercise to illustrate certain details of motion.

FIG. 4A depicts a position similar to that of FIG. 3A and FIG. 4B depicts a positon similar to that of FIG. 3B.

FIG. 6A depicts a typical starting position for an ab crunch exercise and FIG. 6B depicts a typical ending positon.

DETAILED DESCRIPTION OF THE PREFERRED EMBODIMENT(S)

The following detailed description and disclosure illustrates by way of example and not by way of limitation. This description will clearly enable one skilled in the art to make and use the disclosed systems and methods, and describes several embodiments, adaptations, variations, alternatives and uses of the disclosed systems and methods. As various changes could be made in the above constructions without departing from the scope of the disclosures, it is intended that all matter contained in the description or shown in the accompanying drawings shall be interpreted as illustrative and not in a limiting sense.

Although the exercise machines, arms, systems, and methods described below are discussed primarily in terms of their application to a particular layout of exercise machine (s), one of ordinary skill in the art would recognize that what is described herein could be used in a plurality of different exercise machines of different layouts designed to have certain desired footprints and space considerations. These can include, but are not limited to, home and commercial exercise machines of all price ranges. Also, while the exercise machines are primarily discussed as performing an abdominal crunch exercise, they could be readily adapted for use with other types of abdominal exercises. Further, additional components to provide for additional exercises could be added to any of the machines discussed herein that either use the same mechanical arms, or use different mechanisms for providing another exercise on the same frame. Therefore, the below described preferred embodiments should not be used to limit the scope of the disclosed invention.

The advent of the strength machine has made the positioning of the body for weightlifting easier as it is no longer required that the user always "lift" weights (e.g. move in a direction opposing the Earth's gravitational field to get resistance) but can now push or pull on a handle in any direction. This push or pull motion is then mechanically translated to the "lifting" or other resistance. Many exercises are still traditionally performed on a strength machine with the user pushing in a direction which causes the lifting of a mass against the force of gravity, but one of ordinary skill in the art would understand that strength machines can have multiple different layouts to perform similar exercises depending on how resistance is ultimately provided. What matters is that the user's position, relative to the motion of the machine will provide while the exercise is performed, be predetermined for that particular exercise. Therefore, the concepts related to the specific range of motion and elements of that motion could readily be adapted to machines of different types based on the below disclosed embodiments.

Figure 1:
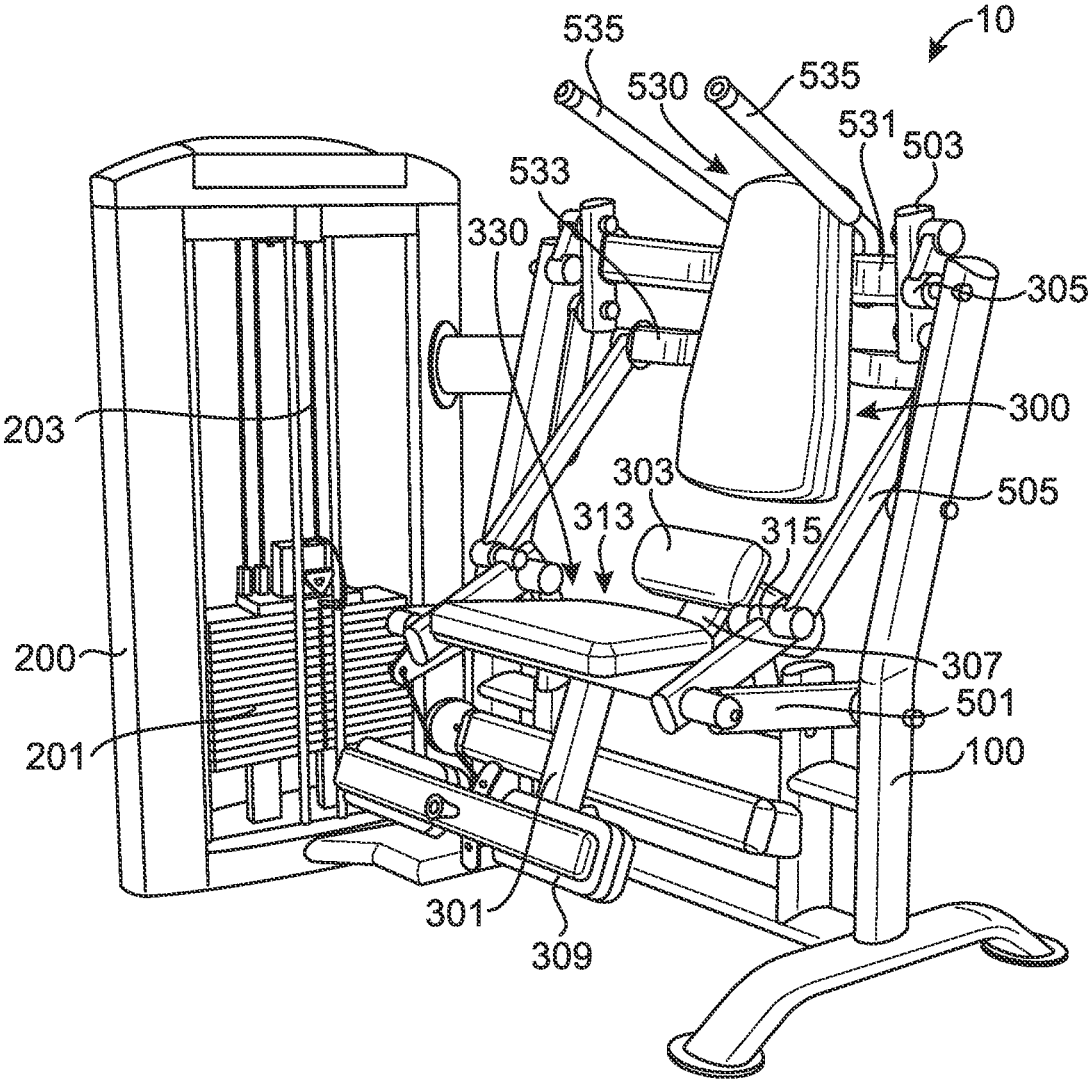
FIG. 1 depicts an embodiment of a perspective view of an abdominal crunch exercise machine
Figure 2:
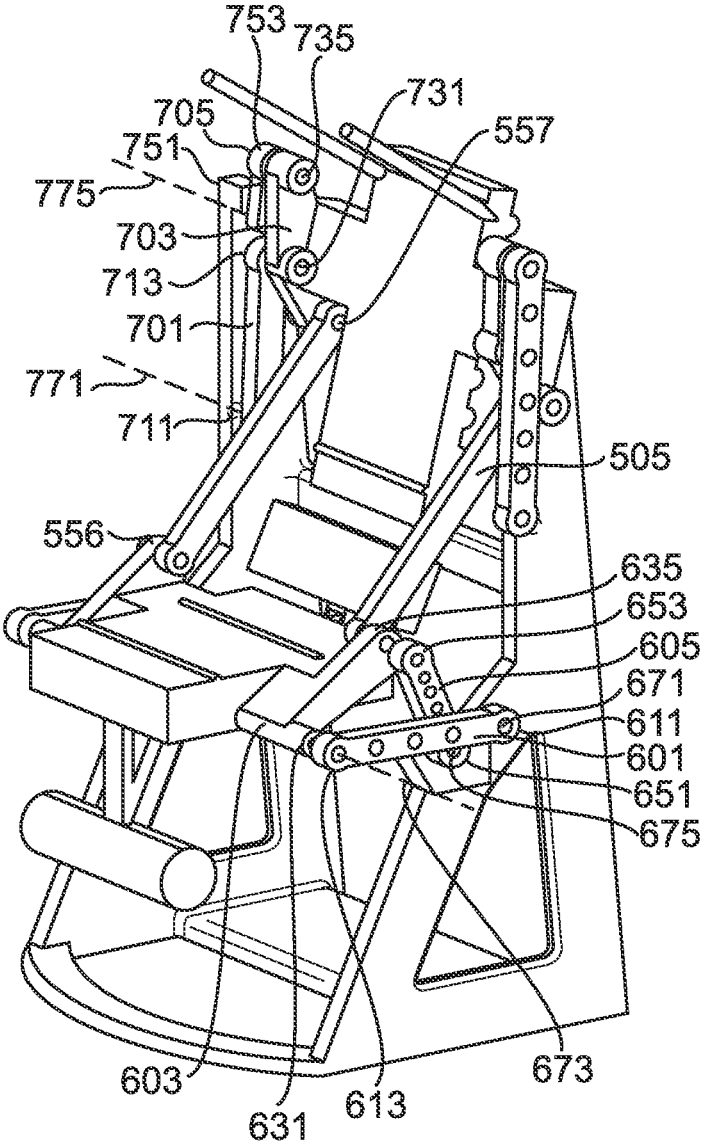
FIG. 2 depicts an embodiment of a perspective view of a portion of an abdominal crunch exercise machine highlighting the linkage assemblies.

In the broadest sense, a strength machine, such as exercise machine (10) of FIG. 1, includes four components. There is some form of resistance which the user will work against, there is a place where the user is placed to interact with the machine, there is a mechanism for transferring the work of the user to the resistance, and there is a frame to support the structure. These general components are described in greater detail with regards to the various FIGS.

Within these general constraints it will be recognized that there are a large number of strength machine designs and the machines described herein represent only some embodiments of the invention. In alternative embodiments, some or all of the frame may be shared by other mechanisms for transferring work from the user to the resistance mechanisms, resistance mechanisms may be shared by mechanisms for transferring work, and the place for the user to interact with the machine may be moveable between different mechanisms for transferring work, or may be positionable to access different mechanisms. Further, mechanisms may be adjustable to accommodate users of different size, shape, or ability.

An embodiment of an abdominal crunch machine is provided in FIG. 1. The machine (10) comprises a support frame (100) which serves to support the other components of the machine relative to each other and also provides a base for the machine (10) on the floor or other surface. The frame (100) is typically rigid and is not intended to move during the exercise. Instead, the frame (100) serves to stabilize the machine relative to the floor and also serves as the structure about which the exercise motion is performed. Thus, when this application discusses the concept of components moving, that movement will typically be relative to the frame (100) which is effectively considered stationary during the exercise motion.

The machine (10) also includes a weight stack (200) which forms the resistance for this particular machine and lifting of the weight away from the floor upon which the machine (10) sits serves to resist the motion of the user performing the exercise. Weights are engaged in the depicted embodiment via cable disc (801) and a cable which is shown in more detail in conjunction with FIGS. 6A and 6B. In alternative embodiments, alternative resistance mechanisms, such as biasing members (springs), or other systems may additionally or alternatively be used.

Returning to FIG. 1, the machine includes a user support (300). The user support (300) in this case comprises three generally padded areas which are designed to support the mass of the user performing the exercise. These three areas are the seat base (301), the seat back (303), and the back rest (305). It should be apparent from FIG. 1 that the seat base (301) and seat back (303) are directly connected to each other by a bar (307) to form a seat (313) upon which the user sits. There may also be a counterweight (315) attached to the back of the bar (307) to assist in offsetting the mass of the user. The seat (313) is also connected to foot pads (309) which are typically rigidly attached to the seat base (301) and extend downward and forward. The seat (313) in combination with the foot pads (309) and all other components rigidly attached to the seat (313) is considered the lower support (330). The lower support (330) is attached to the frame (100) via the first linkage assembly (501) and thus can move relative to the frame (100) via movement of the first linkage assembly (501). The first linkage assembly (501) thus supports the seat (313) and connects it to the frame (100).

The first linkage assembly (501) comprises three primary arms. A first frame rotation arm (601), a seat engaging arm (603), and a second frame rotation arm (605). The first frame rotation arm (601) is rotationally connected at a first end (611) to the frame (100). The opposing second end (613) is connected to a first end (631) of the seat engaging arm (603). The seat engaging arm (603) is also attached to the seat (313) typically in a rigid position and not allowing for rotation. In the depicted embodiment of FIG. 1, the attachment between the seat engaging arm (603) and the seat (313) occurs toward the front of the seat (313) and under it. The opposing end (635) of the seat engaging arm (603) is attached to the first end (653) of the second frame rotation arm (605) while the second end (651) is attached to the frame (100).

As should be apparent from the FIGS., the rotation of the seat is generally accomplished around two separate points. While the axis (673) through the ends (613) and (631) is the point of connection to the seat (313), it does not allow for rotation in any substantial fashion. Further, the axis (673) is not in fixed positon relative to the frame (100). Instead, the axis (673) can move relative to the frame (100). Specifically, when the lower support (330) moves, the seat (313) will typically rotate generally upward and backward along a complex arc involving axes (671), (673), and (675) as rotation occurs. This is shown best in the progression from FIG. 3A, through FIG. 3B, to FIG. 3C and is also shown in the progression from FIG. 4A to FIG. 4B and from FIG. 5A, to FIG. 5B, and FIG. 5C.

Figure 3C:
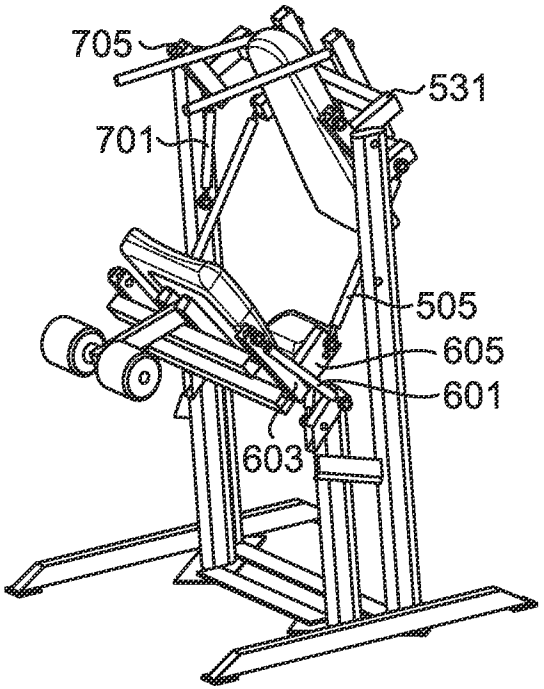
FIGS. 3A, 3B, and 3C depict, in order, perspective views of the movement of the user support portion of an abdominal crunch exercise machine.
Figure 3B:
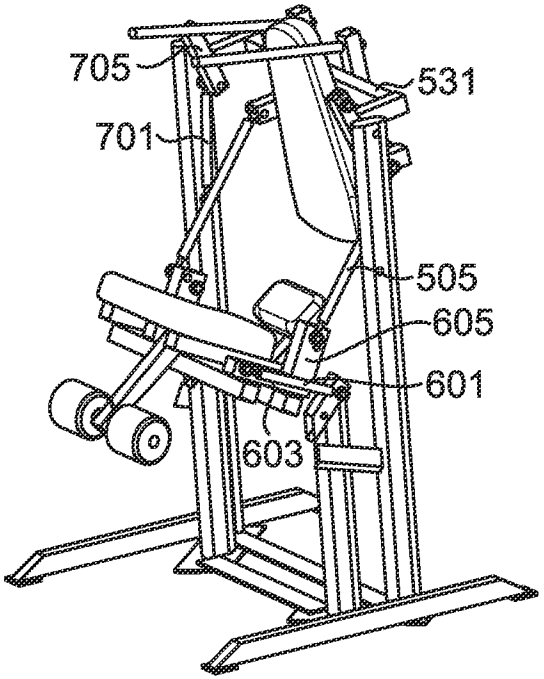
Figure 3A:
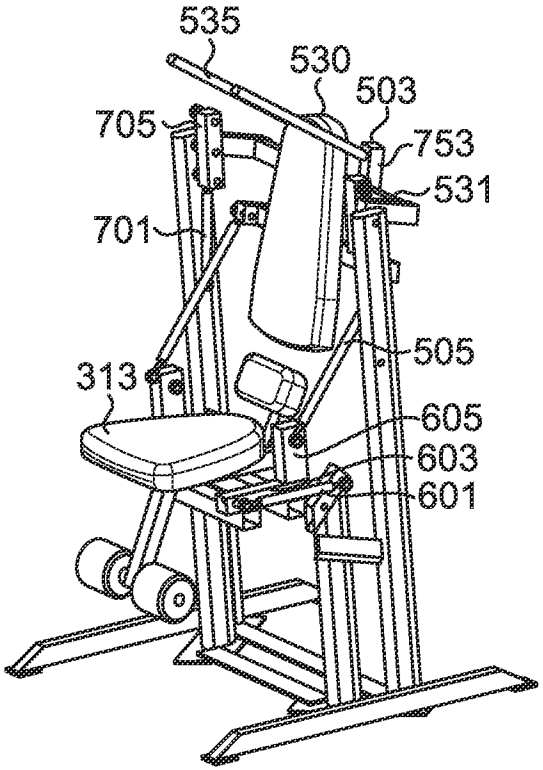
Figure 4A:
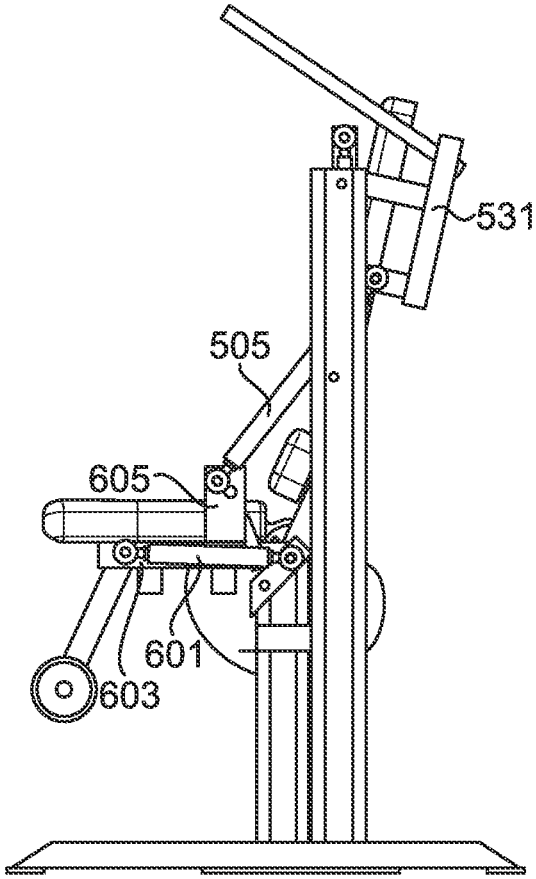
FIGS. 4A and 4B depict, in order, side views of the movement of the user support portion of an abdominal crunch exercise machine.

As is best shown in the various of FIGS. 3A, 3B, and 3C, the user's legs in the this embodiment effectively pull upward as rotation occurs simultaneously around axis (671) and (675). As rotation occurs upward of the seat around axis (671), rotation around axis (675) serves to tilt the seat (313). This results in a smooth motion which is more rolling than bending to the user. The motion of the lower support (330) is coupled to the motion of the upper support (530) via the translation bar (505).

The upper support (530) comprises the back rest (305) which is attached toward its top to a first support bar (531) which is in turn attached to a pair of hand grips (535). The back rest (305) is also attached to a second support bar (533) which is positioned in the middle of the back rest (305). The upper support (530) is not connected directly to the seat (313) or lower support (330). Instead, the back rest (305) is connected to the frame (100) via a second linkage assembly (503). The connection between the second linkage assembly (503), like that of the first linkage assembly (501), involves multiple connection points and is connected to the frame (100) at a point independent from where the first linkage assembly (501) is attached and that point is spaced from the point where the first linkage assembly (501) is attached. In the depicted embodiment, the points of attachment are spaced a substantial distance apart vertically.

The second linkage assembly (503) comprises a first back rotation arm (701), a back engaging arm (703), and a second back rotation arm (705). In the second linkage assembly (503), the first end (711) of the first back rotation arm (701) is rotationally connected to the frame (100). The opposing second end (713) of the first back rotation arm (701) is then connected to the first end (731) of the back engaging arm (703). The back engaging arm (703) is then connected to the first support bar (531) in a generally rigid and non-rotational fashion. The opposing second end (735) of the back engaging arm (703) is then rotationally connected to the first end (753) of the second back rotation arm (705). The second opposing end (751) of the second back rotation arm (705) is then connected at the frame (100).

As was the case with the seat (313) which rotated around two spaced axes of rotation (671) and (675) relative to the frame (100) with the axes (673) serving to interlink the relative motions, the back rest (305) will also rotate around two spaced axes of rotation (771) and (775) relative to the frame (100). As can be best seen in the progression from FIG. 3A, to FIG. 3B, through FIG. 3C, this results in the tilting of the back rest (305) as the back rest (305) moves slightly upwards. As with the lower portion (330) this provides a more rolling motion which makes the motion of the user more natural.

The translation bar (505) serves to interconnect the first linkage assembly (501) with the and second linkage assembly (503). Specifically, the first end (556) of the translation bar (505) is connected to the seat engaging arm (603) in the first linkage assembly (501). It is specifically connected at the second end (635) of the seat engaging arm (603). The second end (557) of the translation bar (505) is connected to the second support bar (533). In the depicted embodiment, it is connected at a point distanced from the axes (771) and (775) to provide for leverage and angle. The second linkage assembly (503) is attached to the first linkage assembly (501) via a translation bar (505) to interlink the motion of the first linkage assembly (501) with the second linkage assembly (503). Specifically, movement of the seat (313) via the first linkage assembly (501) is translated by the translation bar (505) into movement of the second linkage assembly (503) and, thus, the back rest (305). The connection also translates movement in the opposite direction. Together, these cause the lower portion (330) and upper portion (530) to move together and provides for fixed motion between them. Specifically, as the user's arms are typically used to pull on the handgrips (535) and the ankles are pushed against the footpads (309), movement by one body portion makes movement of the other easier. Thus, both halves of the user's body will be engaged to roll the two halves toward each other. As the abdominals provide for the force for such a rolling motion, they will typically be engaged primarily to cause the user to move the exercise machine (10).

Figure 4B:
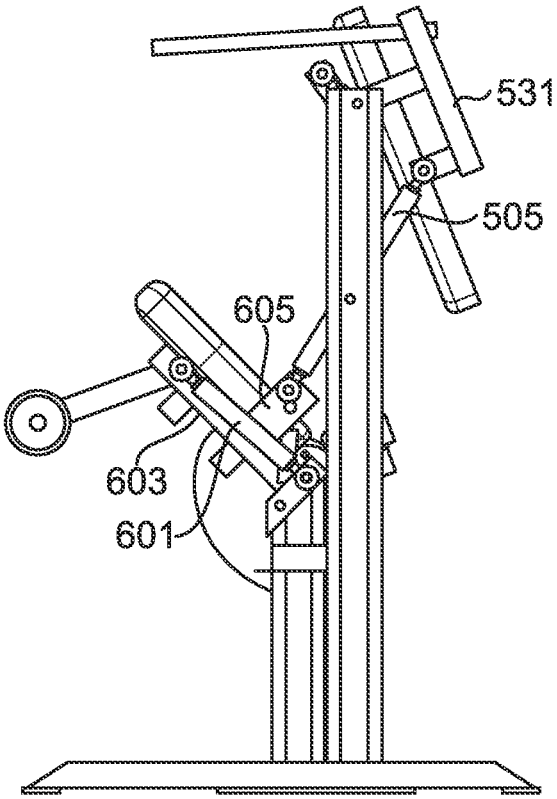
Figure 5A:
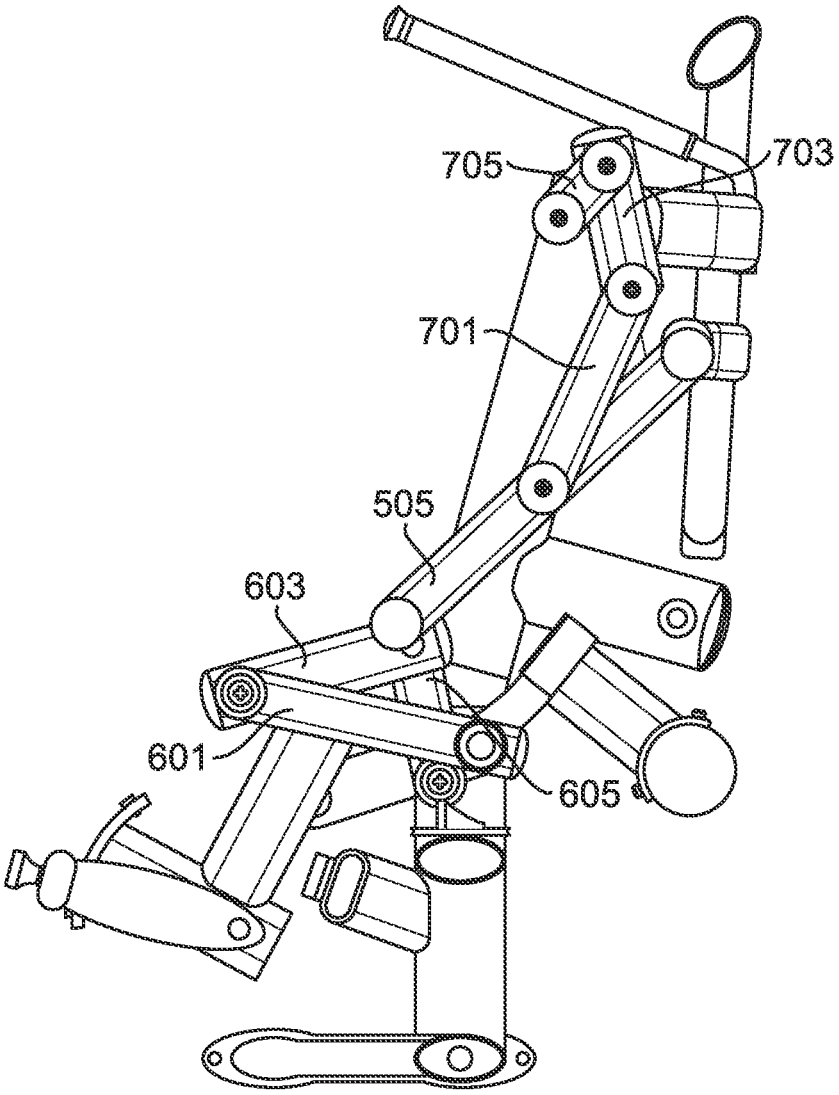
FIGS. 5A, 5B, and 5C depict, in order, partial side views of the movement of the user support portion of an abdominal crunch exercise machine. Multiple parts toward the viewer have been removed to highlight the movement of the linkage assemblies.
Figure 5B:
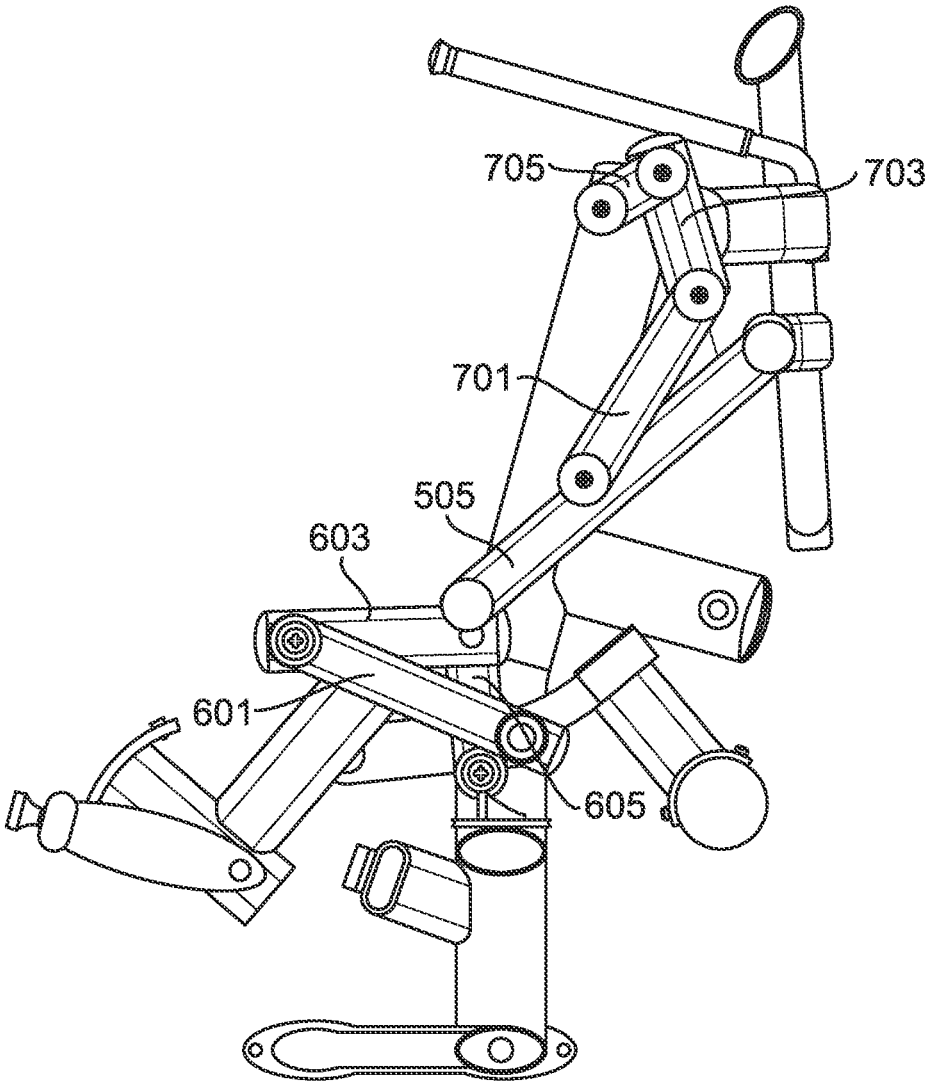
Figure 5C:
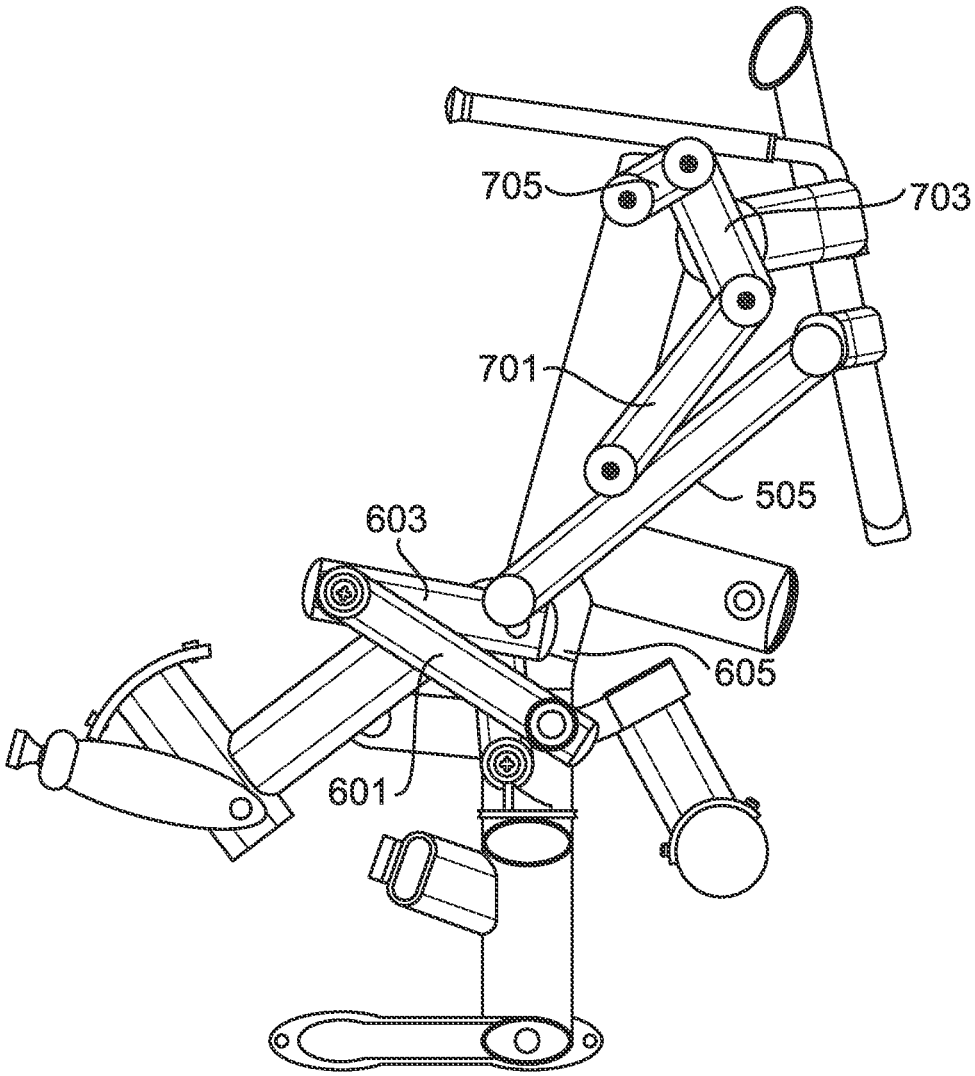

The interconnected motion of the upper portion (530) and lower portion (330) is best shown in the progression from FIG. 3A, to FIG. 3B, to FIG. 3C. This motion is also shown as the progression from FIG. 4A to FIG. 4B and FIG. 5A, to FIG. 5B, to FIG. 5C which provide further illustration. It should be recognized that while FIG. 3C and FIG. 4B provide for an extreme position, this position will actually typically not be used in an actual exercise. Instead, the actual exercise motion will typically only be small and the user will begin at FIG. 3A and may progress only to FIG. 3B or even less total distance in performing the abdominal crunch. The progression from FIG. 5A, to FIG. 5B, and through FIG. 5C illustrates similar positions to those of FIG. 3A, FIG. 3B and FIG. 3C. However, a number of components have been removed in the various FIGS. 5A, 5B, and 5C to better illustrate an embodiment of the first linkage assembly (501) and second linkage assembly (503) movement. The range of motion is also more constrained.

Figure 6A:
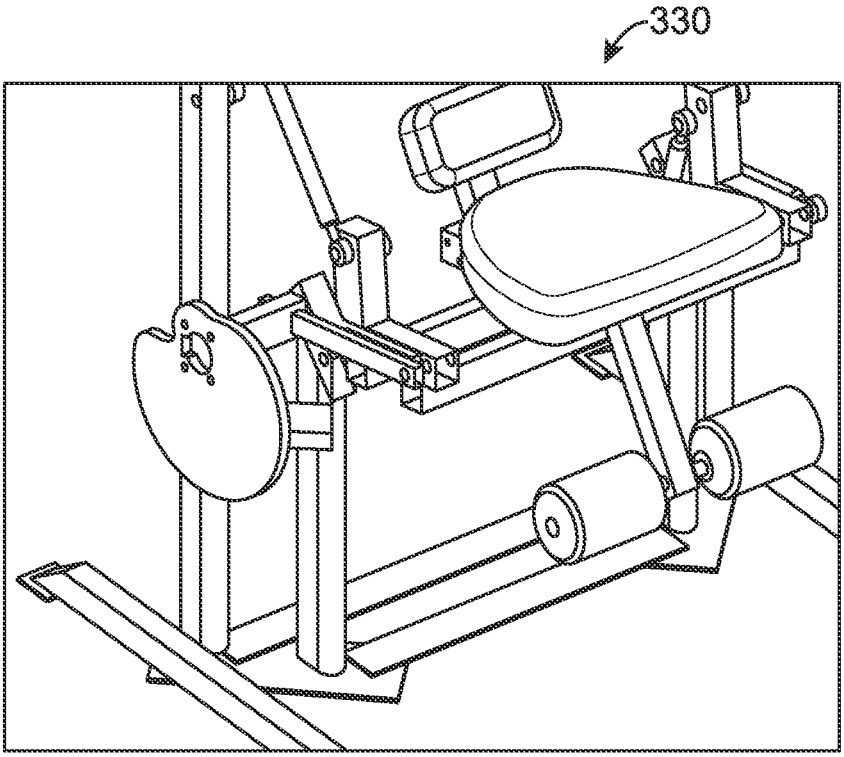
FIGS. 6A and 6B depict, in order, perspective views of the movement of the resistance engagement portions of an abdominal crunch exercise machine.
Figure 6B:
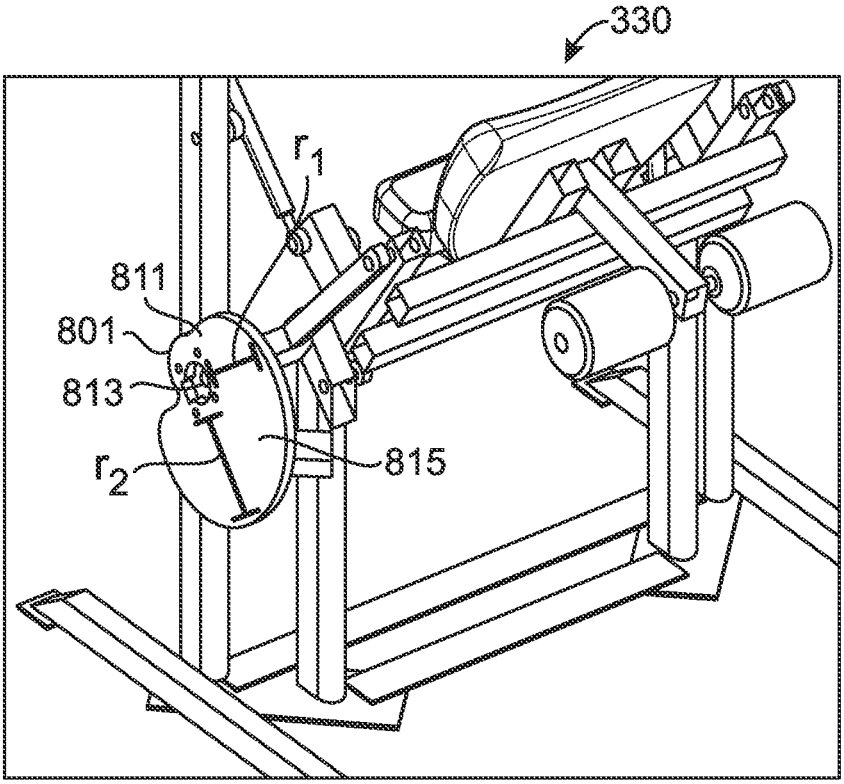

FIGS. 6A and 6B illustrate the motion of the lower portion (330) in conjunction with engagement of a resistance mechanism. In this case, the resistance mechanism would be a weight stack (201) as best shown in FIG. 1. The weights (201) are engaged via a cable disk (801) which would have a cable (203) attached thereto which would engage the cable disk (801) about its perimeter and be attached to the top of the weight stack (201). It should be recognized that the cable disk (801) is not circular, but does have a generally semi-circular section (815). The cable (203) may be attached to the cable disk (801) around point (811), but that is by no means required and is solely illustrative. As should be apparent, the rotational axis (813) of the cable disk (801) is offset from the center of the circular section (815) so that the distance $r_1$ is less than the distance $r_2$. The rotational axis (813) will also typically be around a similar axis to at least one of the lower portion's (330) rotational axis relative to the frame (100). In the depicted embodiment, the rotational axis (813) corresponds to the rotational axis (611) but this is by no means required.

When in operation, the motion of the lower section (330) will typically follow the progression from FIG. 6A to FIG. 6B which will result in the cable disk (801) engaging resistance for that progression of movement. Specifically, the off-centered rotational axis (813) will result in additional cable being engaged as the progression of movement continues due to the increasing distance $r_1$ to $r_2$. This will serve to pull the cable (203) which in turn will lift the weight stack (201). The changing engagement length will result in a smooth lift of the weight (201) which is steadily increasing in height.

The weight lift is typically driven by the legs as the legs are positioned behind the footpads (309). However, it should be apparent that the user cannot simply lift their legs to engage the resistance and lift the weight (201). Instead, the Lifting their legs causes the lower section to rotate and (as can be best seen in FIG. 3B) lift upward toward the chest. Further, due to the transmission link (505), the movement of the lower section (501) also causes the upper section (503) to tilt backward and a little away from the seat back (303). This interlocked motion essentially forces the user to engage their abdominal muscles as they need to "curl up" as that is the motion proscribed by the movement. This is as opposed to more the motion of bending or leaning over which is more the motion proscribed by prior devices.

As should be apparent from examination of FIGS. 3A-3C, 4A-4B, and 5A-5C the exercise motion during the exercise is typically smoother and more natural than the clamshell motion produced by prior devices. Specifically, as the first linkage assembly (501) is attached to the frame by two separate axes (671) and (675) and the second linkage assembly (503) is also attached by two separate axes (771) and (775) each of the lower portion (501) and the upper portion (503) do not simply bend toward each other in a clamshell or "book closing" motion. With a single axis of rotation for each, the motion is necessarily around what is effectively a single hinge point (even if that hinge point is actually offset from the axes of rotation) and that hinge point is stationary relative to the frame (100). In the present embodiments, the motion is not around a static hinge point, but the hinge point can actually move relative to the frame (100). This motion allows for a motion where the legs are more effectively drawn upward toward the chest as the abdominals are used to curl the chest and thighs toward each other.

The qualifier "generally," and similar qualifiers as used in the present case, would be understood by one of ordinary skill in the art to accommodate recognizable attempts to conform a device to the qualified term, which may nevertheless fall short of doing so. This is because terms such as "cylinder" are purely geometric constructs and no real-world component or relationship is truly a "cylinder" in the geometric sense. Variations from geometric and mathematical descriptions are unavoidable due to, among other things, manufacturing tolerances resulting in shape variations, defects and imperfections, non-uniform thermal expansion, and natural wear. Moreover, there exists for every object a level of magnification at which geometric and mathematical descriptors fail due to the nature of matter. One of ordinary skill would thus understand the term "generally" and relationships contemplated herein regardless of the inclusion of such qualifiers to include a range of variations from the literal geometric meaning of the term in view of these and other considerations.

While the invention has been disclosed in conjunction with a description of certain embodiments, including those that are currently believed to be the preferred embodiments, the detailed description is intended to be illustrative and should not be understood to limit the scope of the present disclosure. As would be understood by one of ordinary skill in the art, embodiments other than those described in detail herein are encompassed by the present invention. Modifications and variations of the described embodiments may be made without departing from the spirit and scope of the invention.

It will further be understood that any of the ranges, values, properties, or characteristics given for any single component of the present disclosure can be used interchangeably with any ranges, values, properties, or characteristics given for any of the other components of the disclosure, where compatible, to form an embodiment having defined values for each of the components, as given herein throughout. Further, ranges provided for a genus or a category can also be applied to species within the genus or members of the category unless otherwise noted.

The invention claimed is:

1. An exercise machine comprising:

a frame;

a lower support connected to said frame at two first spaced axes of rotation via a first linkage assembly;

an upper support connected to said frame at two second spaced axes of rotation via a second linkage assembly;

a translation bar connecting said first linkage assembly to said second linkage assembly so that movement of said lower support relative to said frame causes movement of said upper support relative to said frame and movement of said upper support relative to said frame causes movement of said lower support relative to said frame; and a resistance mechanism resisting movement of at least one of said lower support or said upper support relative to said frame.

2. The exercise machine of claim 1 wherein said lower support is rotationally attached to said first linkage assembly via a first additional axis of rotation spaced from said two first spaced axes of rotation connecting said lower support to said frame.

3. The exercise machine of claim 2 wherein said upper support is rotationally attached to said second linkage assembly via a second additional axis of rotation spaced from said two second spaced axes of rotation connecting said upper support to said frame.

4. The exercise machine of claim 1 wherein said upper support is rotationally attached to said second linkage assembly via an additional axis of rotation spaced from said two second spaced axes of rotation connecting said upper support to said frame.

5. The exercise machine of claim 1 wherein said lower support includes a seat and foot pads.

6. The exercise machine of claim 5 wherein said seat comprises a seat base and a seat back.

7. The exercise machine of claim 1 wherein said upper support includes a back rest and hand grips.

8. The exercise machine of claim 1 wherein said first linkage assembly comprises:

a first frame rotation arm rotationally connected at a first end to said frame and rotationally connected at a second end, opposing said first end, to a first end of a seat engaging arm which is attached to said lower support; and a second frame rotation arm rotationally connected at a first end to a second end of said seat engaging arm opposing said first end of said seat engaging arm and rotationally connected at an opposing second end to said frame.

9. The exercise machine of claim 8 wherein said seat engaging arm is rigidly attached to said lower support.

10. The exercise machine of claim 9 wherein said second linkage assembly comprises:

a first back rotation arm rotationally connected at a first end to said frame and rotationally connected at a second end, opposing said first end, to a first end of a back engaging arm which is attached to said upper support; and a second back rotation arm rotationally connected at a first end to a second end of said back engaging arm opposing said first end of said back engaging arm and rotationally connected at an opposing second end to said frame.

11. The exercise machine of claim 10 wherein said back engaging arm is rigidly attached to said upper support.

12. The exercise machine of claim 11 wherein said translation bar is connected at a first end to said second end of said seat engaging arm, and a second end of said translation bar, spaced from said first end of said translation bar, is connected to said upper support at an axis spaced from said first end and said second end of said back engaging arm back rotation arm.

13. The exercise machine of claim 1 wherein said resistance mechanism comprises a weight stack.

14. A method of performing an abdominal crunch exercise, the method comprising:

providing an exercise machine comprising:

a frame;

a lower support including a seat and foot pads, said lower support connected to said frame at two first spaced axes of rotation via a first linkage assembly;

an upper support including a back rest and hand grips, said upper support connected to said frame at two second spaced axes of rotation via a second linkage assembly;

a translation bar connecting said first linkage assembly to said second linkage assembly; and a resistance mechanism resisting movement of at least one of said lower support or said upper support relative to said frame;

sitting on said seat against said back rest;

placing a portion of a lower extremity in contact with said foot pads;

grasping said hand grips; and using abdominal muscles to move at least one of said foot pads or said hand grips against resistance provided by said resistance mechanism where movement of said lower support relative to said frame causes movement of said upper support relative to said frame and movement of said upper support relative to said frame causes movement of said lower support relative to said frame.

15. The method of claim 14 wherein said first linkage assembly comprises:

a first frame rotation arm rotationally connected at a first end to said frame and rotationally connected at a second end, opposing said first end, to a first end of a seat engaging arm which is attached to said lower support; and a second frame rotation arm rotationally connected at a first end to a second end of said seat engaging arm opposing said first end of said seat engaging arm and rotationally connected at an opposing second end to said frame.

16. The method of claim 15 wherein said seat engaging arm is rigidly attached to said lower support.

17. The method of claim 16 wherein said second linkage assembly comprises:

a first back rotation arm rotationally connected at a first end to said frame and rotationally connected at a second end, opposing said first end, to a first end of a back engaging arm which is attached to said upper support; and a second back rotation arm rotationally connected at a first end to a second end of said back engaging arm opposing said first end of said back engaging arm and rotationally connected at an opposing second end to said frame.

18. The method of claim 17 wherein said back engaging arm is rigidly attached to said upper support.

19. The method of claim 18 wherein said translation bar is connected at a first end to said second end of said seat engaging arm, and a second end of said translation bar, spaced from said first end of said translation bar, is connected to said upper support at an axis spaced from said first end and said second end of said back engaging arm.

20. The method of claim 14 wherein said resistance mechanism comprises a weight stack.

* * * * *